US005813608A

United States Patent [19]

Yoshioka et al.

[11] Patent Number: 5,813,608

[45] Date of Patent: Sep. 29, 1998

[54] MULTI-COLOR ROTARY SPRAYGUN AND METHOD OF CLEANING THE SAME

[75] Inventors: Hidehisa Yoshioka; Nobuhiro Takaba, both of Hiroshima-ken, Japan

[73] Assignee: Mazda Motor Corporation, Hiroshima-ken, Japan

[21] Appl. No.: 584,017

[22] Filed: Jan. 11, 1996

[30] Foreign Application Priority Data

Jan. 10, 1995 [JP] Japan ..... 7-001943
Dec. 25, 1995 [JP] Japan ..... 7-337476

[51] Int. Cl.[6] ..... B05B 15/02

[52] U.S. Cl. ..... 239/110; 239/112; 239/223

[58] Field of Search ..... 239/110, 104, 239/106, 112, 223, 224, 225.1, 304, 305

[56] References Cited

U.S. PATENT DOCUMENTS

| | | | |
|---|---|---|---|
| 3,674,205 | 7/1972 | Kock | 239/112 |
| 3,870,233 | 3/1975 | Wilhelm et al. | 239/112 |
| 4,380,321 | 4/1983 | Culbertson et al. | 239/110 |
| 4,643,357 | 2/1987 | Culbertson et al. | 239/223 |
| 4,728,034 | 3/1988 | Matsumura et al. | 239/112 |
| 4,792,092 | 12/1988 | Elberson et al. | 239/112 |
| 4,881,563 | 11/1989 | Christian | 239/106 |

FOREIGN PATENT DOCUMENTS 6-134354 5/1994 Japan .

*Primary Examiner*—Andres Kashnikow
*Assistant Examiner*—Lisa Ann Douglas
*Attorney, Agent, or Firm*—Sixbey, Friedman, Leedom & Ferguson; Gerald J. Ferguson, Jr.; Donald R. Studebaker

[57] ABSTRACT

A multi-color rotary spraygun has a bell-shaped head which is supported for rotation on a front end of a casing. The front end portion of the bell-shaped head is covered with a partition wall having coating material spraying ports. A plurality of coating material lines open into the bell-shaped head at their front ends and are respectively connected to separate coating material sources at their base ends. A coating material supplied to the bell-shaped head from one of the coating material sources through one of the coating material lines is atomized and sprayed on an object through the spraying ports by rotation of the bell-shaped head. The front end portion of a cleaner line which is connected to a cleaner source at its base end is disposed in the bell-shaped head and the front end portion of the coating material lines are disposed around the front end portion of the cleaner line.

25 Claims, 6 Drawing Sheets

MULTI-COLOR ROTARY SPRAYGUN AND METHOD OF CLEANING THE SAME

BACKGROUND OF THE INVENTION

1. Field of the invention

This invention relates to a multi-color rotary spraygun in which a plurality of coating material passages open into a bell-shaped head and a method of cleaning the multi-color rotary spraygun 2. Description of the Related Art As disclosed, for instance, in Japanese Unexamined Patent Publication No. 6(1994)-134354, there has been known a multi-color rotary spraygun which comprises a bell-shaped head which is supported for rotation on a front end of a casing and the front end portion of which is covered with a partition wall having coating material spraying ports on the peripheral surface thereof, and a plurality of coating material lines which open into the bell-shaped head at their front ends and are respectively connected to separate coating material sources at their base ends and in which a coating material supplied to the bell-shaped head from one of the coating material sources through one of the coating material lines is atomized and sprayed on an object through the spraying ports by rotation of the bell-shaped head. In the multi-color rotary spraygun, each coating material line is provided with a cleaner line for cleaning the front end of the coating material line which opens into the bell-shaped head coaxially with the coating material line at its front end and is connected to a cleaner source at its base end. The front end portion of the cleaner line has a diameter larger than that of the coating material line and surrounds the front end portion of the coating material line. Each time the coating color is changed, the front end portion of the coating material line for the preceding coating color is cleaned by cleaner supplied through the cleaner line for the specific coating material line and then a different coating material is supplied to the bell-shaped head from a coating material source through the coating material line for the coating material.

However the conventional multi-color rotary spraygun is disadvantageous in that since each of the coating material lines is provided with a cleaner line coaxially therewith, the structure of the coating material lines and the cleaner lines is complicated and the diameter of the line for each color is enlarged, whereby the rotary spraygun becomes large in size.

SUMMARY OF THE INVENTION

In view of the foregoing observations and description, the primary object of the present invention is to provide a multi-color rotary spraygun having a cleaning system which is compact and simple in structure.

Another object of the present invention is to provide a method which makes it feasible of clean a multi-color rotary spraygun with a simple and compact cleaning system.

The multi-color rotary spraygun in accordance with the present invention comprises a bell-shaped head which is supported for rotation on a front end of a casing and the front end portion of which is covered with a partition wall having coating material spraying ports, and a plurality of coating material lines which open into the bell-shaped head at their front ends and are respectively connected to separate coating material sources at their base ends and a coating material supplied to the bell-shaped head from one of the coating material sources through one of the coating material lines is atomized and sprayed on an object through the spraying ports by rotation of the bell-shaped head. The rotary spraygun of the present invention is characterized in that the front end portion of a cleaner line which is connected to a cleaner source at its base end is disposed in said bell-shaped head and the front end portion of said coating material lines are disposed around the front end portion of the cleaner line.

It is preferred that a coating material line nozzle opening be provided in the front end portion of the cleaner line so that cleaner supplied from the cleaner source through the cleaner line is ejected radially through the coating material line nozzle opening and cleans the front end portions of the coating material lines.

Preferably the front ends of the coating material lines project toward the partition wall beyond the coating material line nozzle opening.

The coating material line nozzle opening is generally formed in the peripheral wall of the front end portion of the cleaner line.

It is preferred that a guide passage for leading the cleaner ejected through the coating material line nozzle opening to the front ends of the coating material lines be further formed on the outer peripheral surface of the front end portion of the cleaner line.

It is especially preferred that the front end portion of the cleaner line extends on the rotational axis of the bell-shaped head and the front end portions of the coating material lines are disposed around the front end portion of the cleaner line at predetermined angular intervals.

Preferably the front end face of each of the coating material lines is tapered so that the distance from the partition wall decreases toward the rotational axis of the bell-shaped head.

Further it is preferred that a central nozzle opening be formed in the front end of the cleaner line to supply cleaner toward the partition wall opposed to the front end of the cleaner line.

Further it is preferred that a central opening be formed in the central portion of the partition wall to extend through the partition wall at a portion substantially opposed to the central nozzle opening.

Preferably the partition wall is provided with a protrusion which projects toward the central nozzle opening.

Generally, the cleaner line has a cleaner piping portion which leads the cleaner from the cleaner source to the front end portion of the cleaner line and the cleaner piping portion is provided with a cleaner supply gate valve which cuts and supplies the cleaner to the front end portion of the cleaner line.

It is preferred that the cleaner supply gate valve comprises a cleaner source gate valve which selectively provides and breaks communication between the cleaner source and the cleaner line and a cleaner line gate valve which selectively provides and breaks communication between the cleaner piping portion and the front end portion of the cleaner line.

Generally each of the coating material lines has a coating material piping portion which leads the coating material from the coating material source to the front end portion of the coating material line and the coating material piping portion is provided with a coating material supply gate valve which cuts and supplies the coating material to the front end portion of the coating material line.

In one embodiment of the present invention, a cleaner piping for the coating material line is provided between the coating material pipings and the cleaner piping and a cleaner supply gate valve for the coating material piping which selectively cuts and supplies the cleaner to the coating material pipings is provided in the cleaner piping for the coating material line.

It is especially preferred that the cleaner line and the coating material lines are disposed in a cylindrical rotary shaft of a motor for rotating the bell-shaped head.

In accordance with another aspect of the present invention, there is provided a method of cleaning a multi-color rotary spraygun comprising a bell-shaped head and a cleaner line and a plurality of coating material lines whose front ends open into the bell-shaped head, the coating material lines being connected respectively to separate coating material sources of different colors and the coating material in one of the coating material sources being selectively supplied to the bell-shaped head. The method is characterized in that cleaner is ejected through said cleaner line to clean the bell-shaped head and the front end portions of the coating material lines which are disposed around the cleaner line when the coating color is changed.

It is preferred that also the inside of at least one of the coating material lines is cleaned when the coating color is changed.

It is preferred that cleaning of the inside of the coating material line be effected before cleaning of the front end portions of the coating material lines.

Cleaning of the inside of the coating material line for a certain coating material may be effected together with color change which is effected a predetermined time after change from said certain coating material to another coating material.

Cleaning of the inside of the coating material line may be effected simultaneously for all the coating material lines together with color change which is effected a predetermined time after the preceding cleaning.

Cleaning of the coating material line for a certain coating material may be effected together with color change which is effected after a predetermined number of color changes as numbered from color change from said certain coating material to another coating material.

Cleaning of the inside of the coating material line may be effected simultaneously for all the coating material lines and is effected together with color change which is effected after a predetermined number of color changes as numbered from the preceding cleaning.

In the rotary spraygun of the present invention, the front portions of a plurality of coating material lines are disposed around the front end portion of a cleaner line. Accordingly. the front end portions of the coating material lines are easily cleaned by cleaner supplied through the single cleaner line and at the same time cleaner consumption is reduced. This greatly simplifies the structure of the bell-shaped head as compared with the conventional system where a cleaner line is provided for each coating material line. Further the passage for each color can be smaller in diameter as compared with that of the conventional system where the cleaner line is provided coaxially with each coating material line, whereby the rotary spraygun can be more compact.

When the front ends of the coating material lines project toward the partition wall beyond the coating material line cleaning nozzle openings, coating material adhering to the front end portions of the coating material nozzles can be smoothly and surely removed.

Further when cleaner is supplied toward the top of the protrusion on the inner surface of the partition wall through the central nozzle opening, the cleaner is effectively led to the inner surface of the partition wall, whereby the inner surface of the partition wall can be surely cleaned. At the same time, when the central opening extends through the partition wall at the center thereof substantially opposed to the central nozzle opening, the cleaner supplied toward the partition wall through the central nozzle opening is ejected to the outer surface of the partition wall through the central opening, whereby the outer surface of the partition wall can be effectively cleaned.

DESCRIPTION OF THE PREFERRED EMBODIMENT

Figure 3:
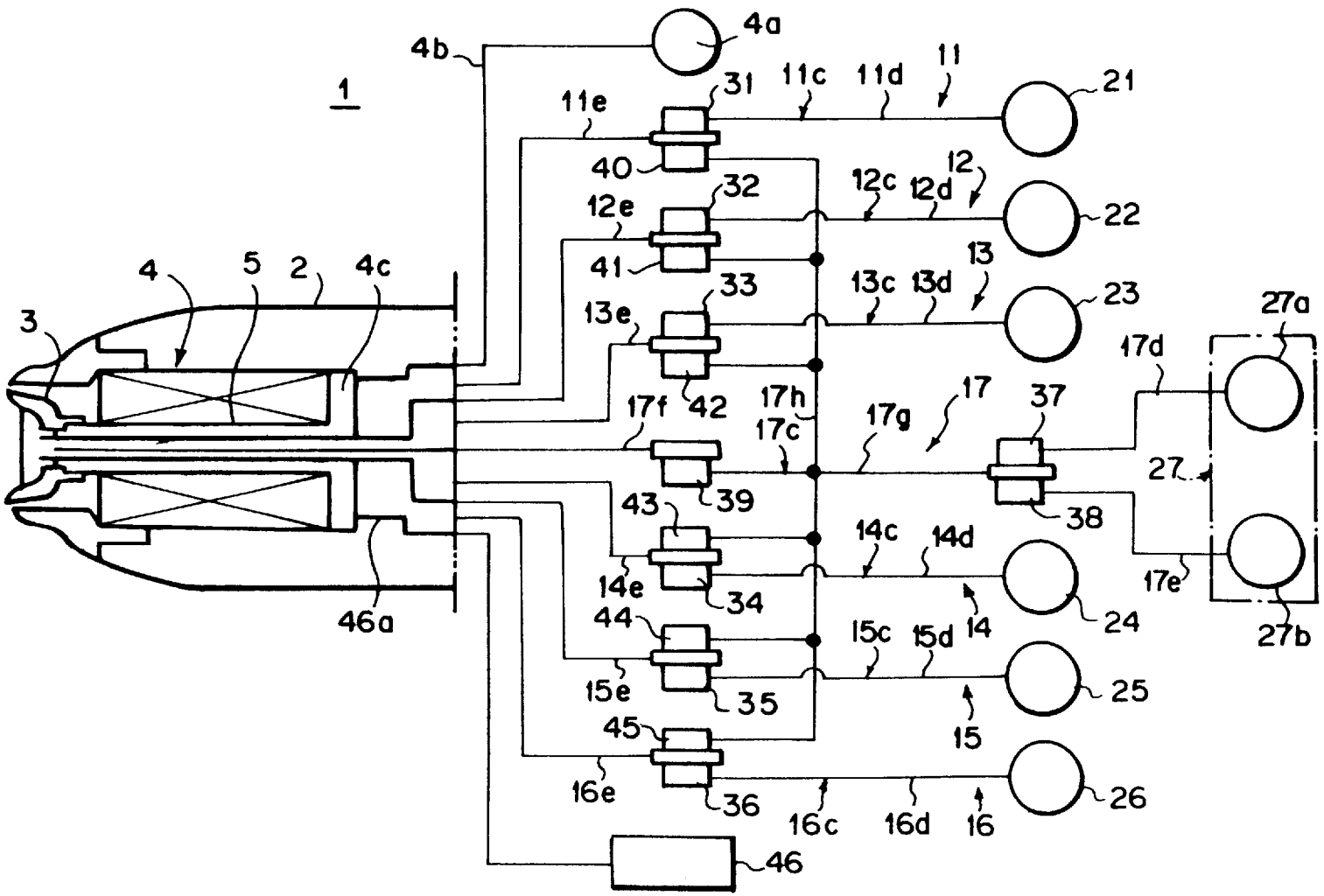
FIG. 3 is a schematic view showing the overall structure of the multi-color rotary spraygun of the first embodiment.
Figure 4:
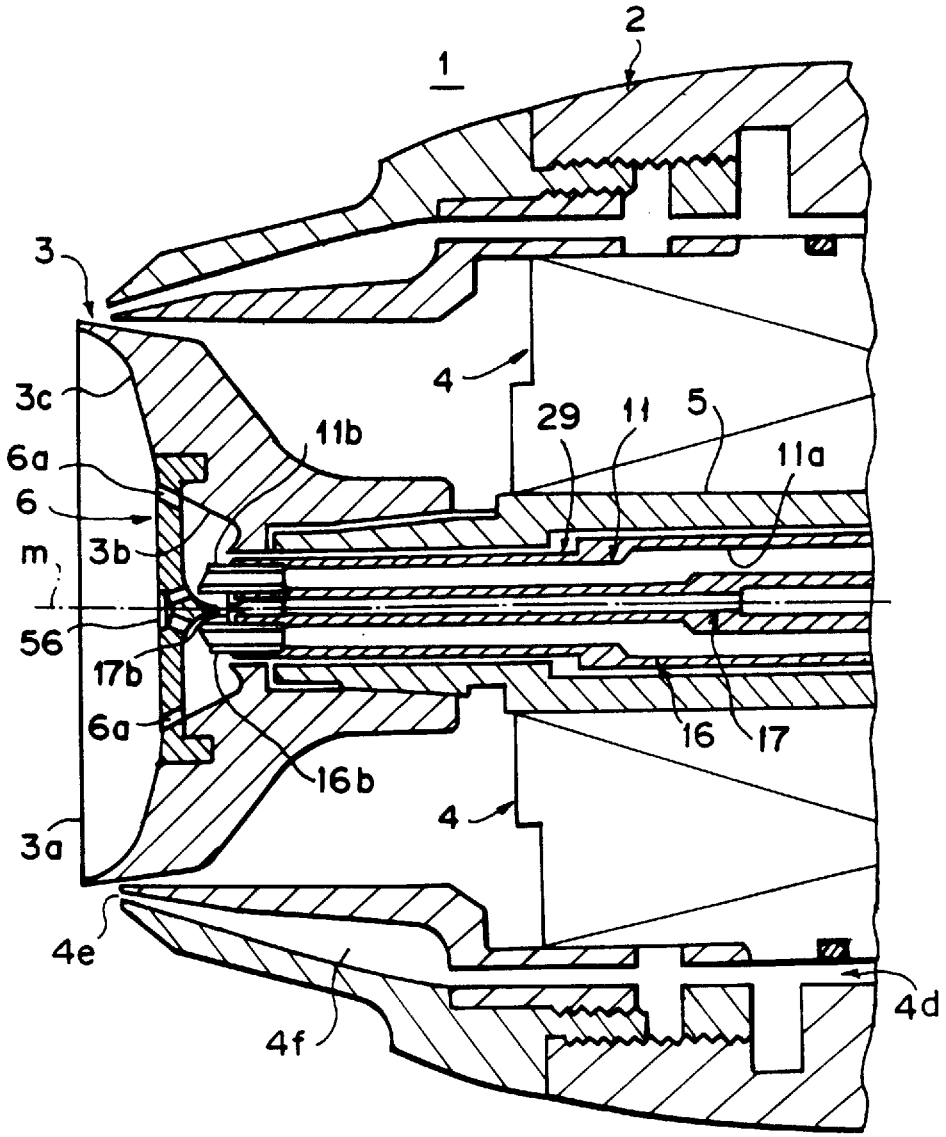
FIG. 4 is a cross-sectional view showing the front end portion of the rotary spraygun.

In FIG. 4, a multi-color rotary spraygun 1 in accordance with a first embodiment of the present invention is housed in a cannonball-shaped hollow casing 2. The front end of the rotary spraygun 1 opens outward and the base end portion of the rotary spraygun 1 is connected to an arm of a robot (not shown). The casing 2 is tapered toward its front end and a bell-shaped head 3 is supported for rotation in the front end portion of the casing 2. The bell-shaped head 3 has an opening at its front end and the base end is fixed to a cylindrical motor shaft 5 which is driven by an air motor 4 provided in the casing 2. The air motor 4 is rotated by blowing air supplied from an external air source 4*a* through an air supply line 4*b* on fans 4*c*. (FIG. 3)

The inner peripheral surface of the bell-shaped head 3 comprises a small diameter portion 3*b* which is relatively small in diameter and is gently tapered relative to the rotational axis m of the motor shaft 5 and a large diameter portion 3*c* which is relatively large in diameter and is steeply tapered relative to the rotational axis m of the motor shaft 5. The large diameter portion 3*c* is positioned between the small diameter portion 3*b* and the opening 3*a*. A disk-like partition wall 6 is provided on the front end of the small diameter portion 3*b* to cover the front end of the small diameter portion 3*b*. A plurality of coating material spraying ports 6*a* are formed in the partition wall 6 at predetermined intervals along the peripheral edge of thereof to communicate the small diameter portion 3*b* and the large diameter portion 3*c*. Each of the spraying ports 6*a* extends through the partition wall 6 to conform to the taper of the small diameter portion 3*b*. The outer surface of the partition wall 6 is shaped to smoothly merge into the inner surface of the large diameter portion 3*c*.

As shown in FIG. 3, first to sixth coating material lines 11 to 16 are provided in the casing 2 to open in the inner surface of the bell-shaped head 3. The base end of the coating material lines 11 to 16 are respectively connected to coating material sources 21 to 26 of different colors. Further a cleaner line 17 is provided in the casing 2 to open in the inner surface of the bell-shaped head 3. The base end of the cleaner line 17 is connected to a cleaner source 27 which comprises a thinner source 27*a* which supplies thinner as a cleaner and a pressurized air source 27*b* which supplies pressurized air as a cleaner.

Figure 1:
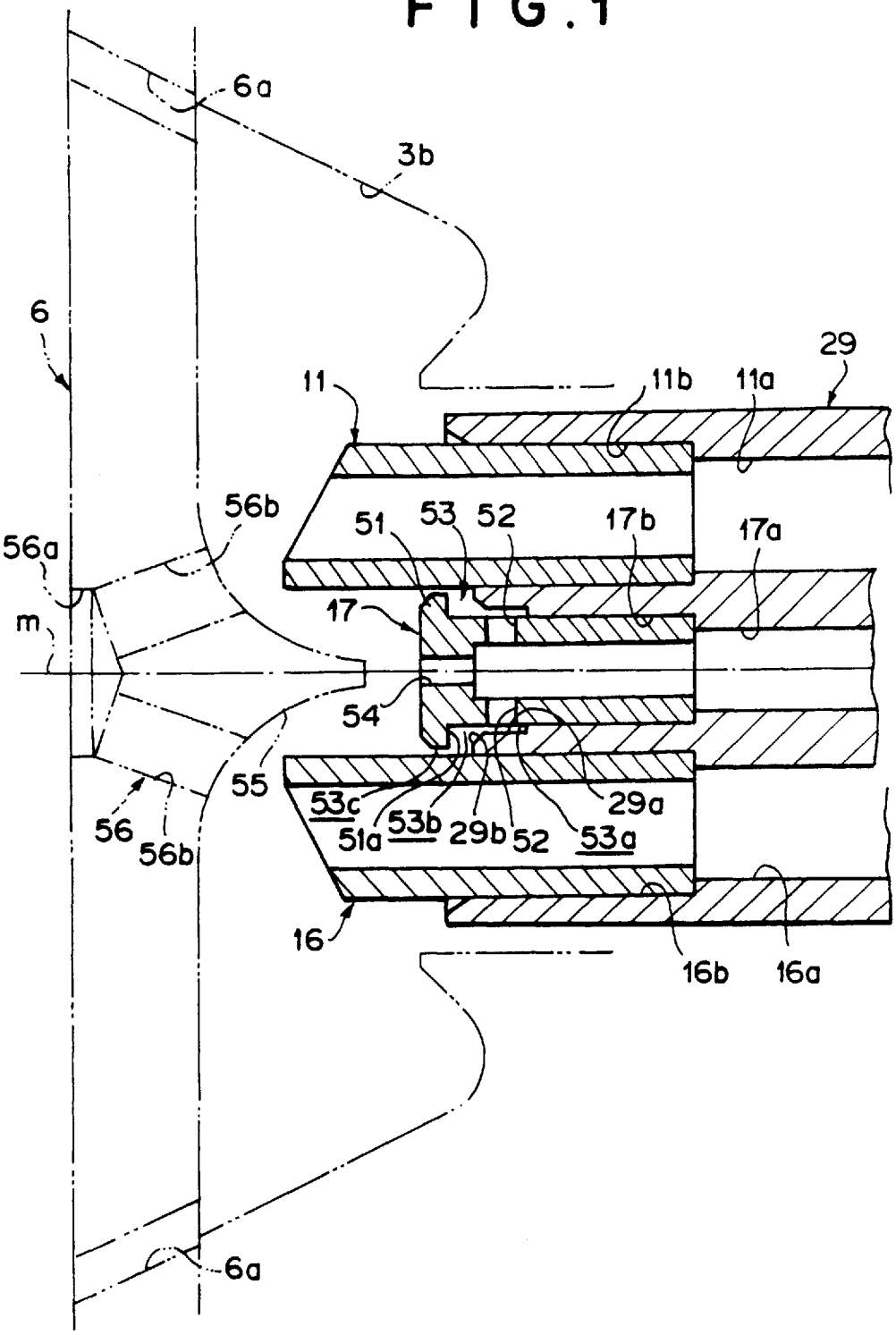
FIG. 1 is a cross-sectional view showing the coating material nozzles and the cleaner nozzle employed in a multi-color rotary spraygun of a first embodiment of the present invention.
Figure 2:
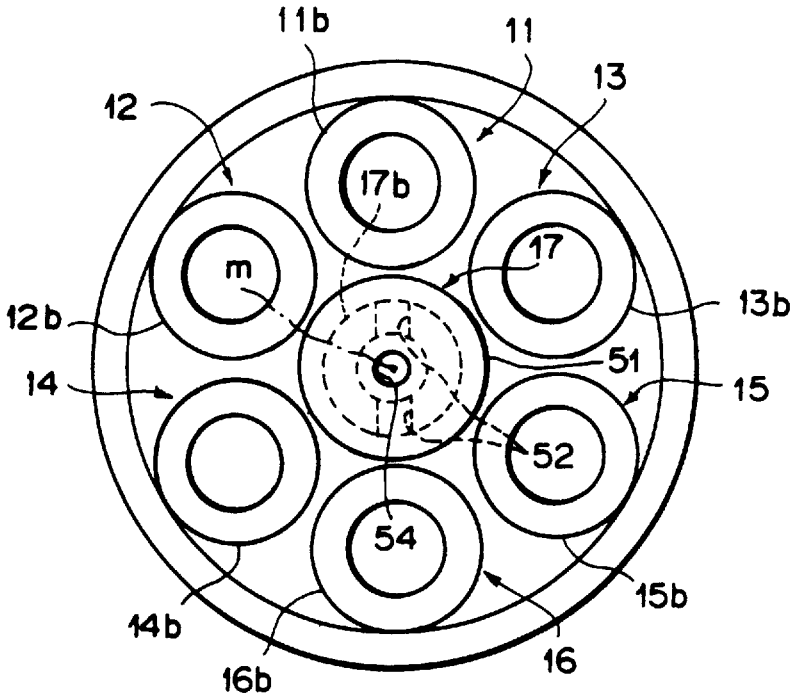
FIG. 2 is a front view showing the coating material nozzles and the cleaner nozzle.

As shown in FIGS. 1 to 3, the cleaner line 17 comprises a cleaner passage 17*a* extending in alignment with the rotational axis m of the motor shaft 5 which is in alignment with the rotational axis of the bell-shaped head 3, a cleaner nozzle 17*b* fitted on the front end of the cleaner passage 17*a* and a cleaner piping 17*c* connected to the base end of the cleaner passage 17*a*. The coating material lines 11 to 16 comprise coating material passages 11*a* to 16*a* disposed around the cleaner passage 17*a* at predetermined intervals, coating material nozzles 11*b* to 16*b* fitted on the front ends of the coating material passages 11*a* to 16*a* and coating material pipings 11*c* to 16*c* separately connected to the base ends of the coating material passages 11*a* to 16*a*. The coating material passages 11*a* to 16*a* and the cleaner passage 17*a* are provided in the motor shaft 5 and are formed in a rod-like core material 29 loosely fitted in the motor shaft 5. Each of the passages 11*a* to 17*a* is about 2 to 3 mm in diameter. A coating material supplied to the bell-shaped head 3 from one of the coating material sources 21 to 26 through the coating material line connected to the coating material source is atomized and sprayed on an object (not shown) through the spraying ports 6*a* by rotation of the bell-shaped head 3.

The coating material pipings 11*c* to 16*c* comprise upstream side pipings lid to 16*d* which are connected to the respective coating material sources 21 to 26 at their base (upstream side) ends and downstream side pipings 11*e* to 16*e* which are connected to the respective coating material passages 11*a* to 16*a* at their front (downstream side) ends. Between each upstream side piping and the downstream side piping is disposed an on-off gate valve (first to sixth coating material supply gate valves 31 to 36) which selectively supplies or cuts the coating material to the downstream side.

The cleaner piping 17*c* comprises a thinner upstream side piping 17*d* connected to the thinner source 27*a* at its base end and a pressurized air upstream side piping 17*e* connected to the pressurized air source 27*b* at its base end. A downstream side cleaner piping 17*f* is connected to the cleaner passage 17*a* at its front end and an upstream side cleaner piping 17*g* is connected to the downstream side cleaner piping 17*f* by way of a ninth on-off gate valve (cleaner piping gate valve) 39 at its front end. The thinner upstream side piping 17*d* and the pressurized air upstream side piping 17*e* are connected to the upstream side cleaner piping 17*g* respectively by way of seventh and eighth on-off gate valves (cleaner supply gate valves) 37 and 38 at their front ends. The seventh to ninth gate valves 37, 38 and 39 cut and supply to the downstream side.

A cleaner piping 17*h* for the coating material lines branches off from the upstream side cleaner piping 17*g* and is connected to the upstream side ends of the downstream side pipings 11*e* to 16*e* for the coating materials respectively by way of tenth to fifteenth on-off gate valves (cleaner supply gate valves for the coating material pipings) 40 to 45. When one of the tenth to fifteenth gate valves 40 to 45 is opened with one of the seventh and eighth gate valves 37 and 38 opened, thinner or pressurized air is supplied to the corresponding downstream side piping for the coating material and the area from the upstream side end of the downstream side piping to the coating material nozzle is cleaned by the thinner or pressurized air.

Figure 5:
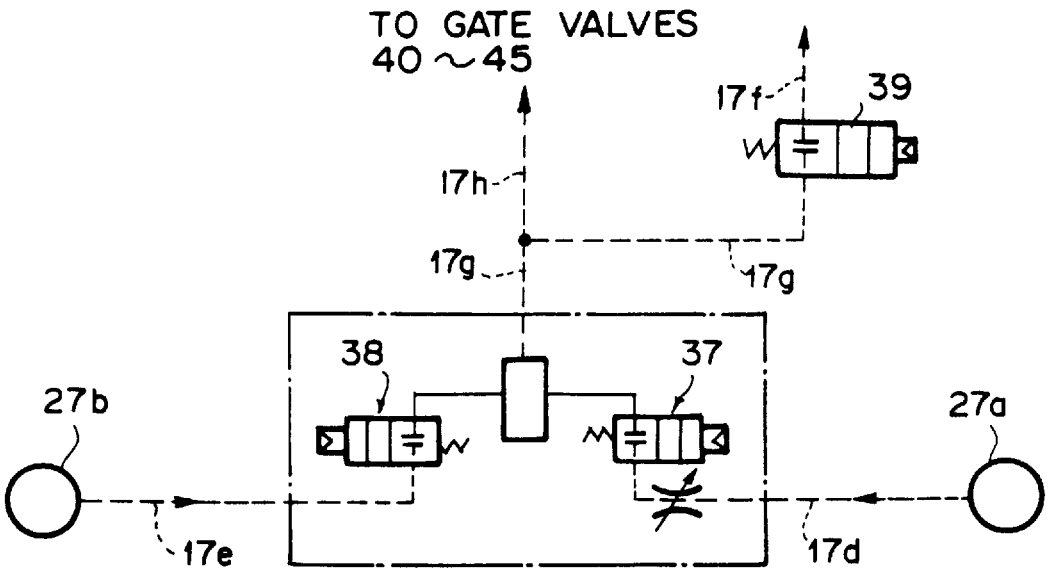
FIG. 5 is a schematic view for illustrating the cleaner supply gate valve.

An example of the seventh to ninth gate valves 37 to 39 is shown in FIG. 5. As can be understood from FIG. 5, each of the seventh to ninth gate valves 37 to 39 may be just an on-off valve.

Figure 6:
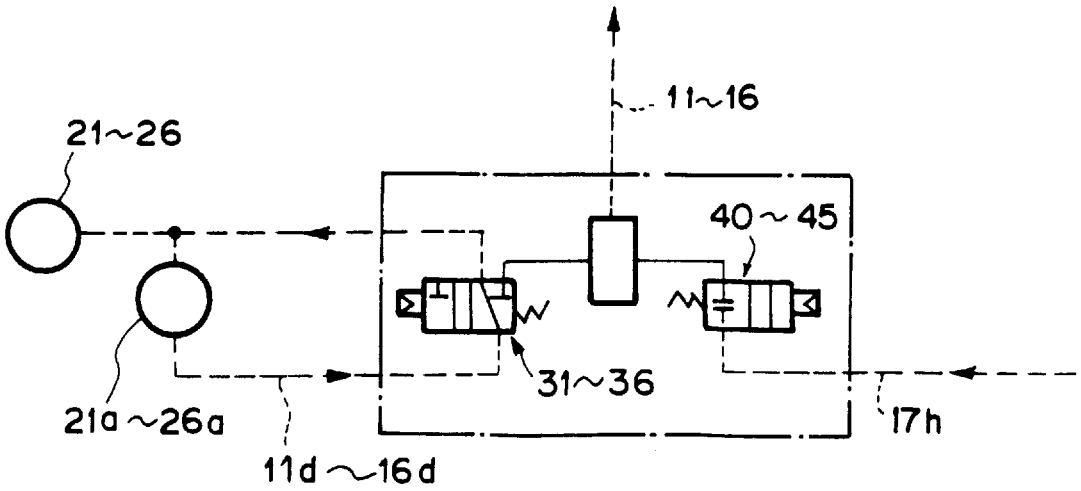
FIG. 6 is a schematic view for illustrating the coating material supply gate valve and the cleaner piping gate valve.

An example of first to sixth and tenth to fifteenth gate valves 31 to 36 and 40 to 45 is shown in FIG. 6. As can be understood from FIG. 6. each of those gate valves may be just an on-off valve. The first to sixth gate valves 31 to 36 are arranged so that the coating materials are constantly circulated in a closed loop by coating material supply pumps 21*a* to 26*a* when the gate valves 31 to 36 are in a supply cut position where the coating materials are not supplied to the coating material passages 11*a* to 16*a* (the illustrated valve positions).

As shown in FIG. 3, a high voltage of 90,000 v is applied to the bell-shaped head 3 from a high voltage generator 46 through a high voltage supplier 46*a* in the casing 2, the air motor 4 and the motor shaft 5 so that the high voltage is imparted to the coating material in the coating material passage, whereby the coating material is apt to adhere to the object which is grounded. At this time, air discharged from the air motor through the outer peripheral surface of the bell-shaped head 3 provides directivity to atomized coating material, whereby coating is effected smoothly. That is, as shown in FIG. 4, a plurality of air discharge passages 4*d* are formed in the casing 2 to extend to the front end of the bell-shaped head 3 and exit air of the air motor 4 is ejected through front ends 4*e* of the air discharge passages 4*d*. The air discharge passages 4*d* are arranged in the peripheral direction of the casing 2 at predetermined angular intervals and are connected with each other at their front end portions 4*f* to form a continuous annular passage. The air ejected through the front ends 4*f* of the air discharge passages 4*d* controls divergence of atomized coating material radially sprayed through the bell-shaped head 3.

It is an important feature of the present invention that a collar portion 51 extends radially outwardly from the front of the cleaner nozzle 17*b* as clearly shown in FIG. 1. A pair of coating material line cleaning nozzle openings 52 are formed in the front end portion of the cleaner nozzle 17*b* on the upstream side of the collar portion 51 to extend radially outwardly spaced from each other at 180°. The thinner and the pressurized air supplied from the thinner source 27*a* and the air source 27*b* through the cleaner line 17 are ejected radially outwardly through the coating material line cleaning nozzle openings 52. The front ends of the coating material nozzles 11*b* to 16*b* are positioned nearer to the partition wall 6 than the openings 52.

A guide passage 53 for leading the cleaner and air ejected through the nozzle openings 52 to the front ends of the coating material nozzles 11*b* to 16*b* is provided on the outer peripheral surface of the front end portion of the cleaner nozzle 17*b*. The guide passage 53 comprises a first gap 53*a* which is formed between the outer peripheral surface of the front end portion of the cleaner nozzle 17*b* and a recess 29*a* in the core material 29 opposed to each coating material line cleaning nozzle opening 52 to open forward, a space 53*b* which is formed between the rear surface 51*a* of the collar portion 51 and the front end face 29*b* of the core material 29 opposed to the rear surface 29*b* and communicates with the first gap 53*a* and a second gap 53*c* which is formed between the outer peripheral surface of the collar portion 51 and the outer surface of the front end portions of the coating material nozzles 11*b* to 16*b*.

The front end face of the cleaner nozzle 17*b* is provided with a central nozzle opening 54 through which the cleaner is supplied toward the central portion of the partition wall 6. A conical protrusion 55 is formed at the central portion of the partition wall 6 to project toward the central nozzle opening 54. The partition wall 6 is provided with a central opening 56 which extends through the partition wall 6 from a position substantially opposed to the central nozzle opening 54 at the base of the protrusion 55 to the center of the partition wall 6. The central opening 56 of the partition wall 6 comprises a recess 56*a* formed on the outer or front surface of the partition wall 6 and a plurality of through holes 56*b* which obliquely extends through the partition wall 6 from a portion near the base of the protrusion 55 to the recess 56*a*. Further the front end face of each of the coating material nozzles 11*b* to 16*b* is tapered so that the distance from the partition wall 6 decreases toward the rotational axis of the bell-shaped head 3 so that the coating material supplied from the coating material line is easily led toward the spraying ports 6*a*.

Color change operation in the multi-color rotary spraygun will be described, hereinbelow, taking the case where the coating material is changed from that in the first coating material source 21 to that in the second coating material source 22 for example. That is, the first to sixth gate valves 31 to 36 are once closed to break communication between the upstream side pipings lid to 16*d* and the downstream side pipings 11*e* to 16*e*. In this state, operation of opening the seventh and ninth gate valves 37 and 39 and supplying thinner from the thinner source 27*a* to the cleaner nozzle 17*b* through the cleaner line 17 and operation of opening the eighth and ninth gate valves 38 and 39 and supplying pressurized air from the pressurized air source 27*b* to the cleaner nozzle 17*b* through the cleaner line 17 are alternately repeated. The thinner and pressurized air alternately radially ejected through the nozzle opening 52 for the coating material line are led near the front end portions of the coating material nozzles 11*b* to 16*b* through the guide passage 53 and then to the small diameter portion 3*b* of the bell-shaped head 3, whereby the front end portions of the coating material nozzles 11*b* to 16*b* and the small diameter portion 3*b* of the bell-shaped head 3 are cleaned.

The thinner and the pressurized air ejected through the central nozzle opening 54 of the cleaner nozzle 17*b* are supplied toward the inner surface of the partition wall 6 to clean the inner surface of the partition wall 6 and then discharged through the spraying ports 6a together with those ejected through the nozzle opening 52 for the coating material line while cleaning the spraying ports 6*a*. Further the thinner and the pressurized air ejected through the central nozzle opening 54 of the cleaner nozzle 17*b* are led to the central portion of the outer surface of the partition wall 6 through the central opening 56 to clean the central opening 56 and the outer surface of the partition wall 6, and then clean the large diameter portion 3*c* of the bell-shaped head 3 together with those discharged through the spraying ports 6*a*.

After cleaning, the seventh to ninth gate valves 37 to 39 are closed to shut the thinner upstream side piping 17*d*, pressurized air upstream side piping 17*e* and upstream side cleaner piping 17*g* and then the second gate valve 32 is opened to supply the coating material in the second coating material source 22 to the bell-shaped head 3 through the second coating material line 12.

The downstream portions of the coating material lines 11 to 16 downstream of the gate valves 31 to 36 may be cleaned as desired. For example, when the first coating material line 11 is to be cleaned, the first gate valve 31 between the upstream side piping lid and the downstream side piping 11*e* is closed and the tenth gate valve 40 between the downstream side piping 11*e* and the cleaner piping 17*h* for the coating material lines is opened. Then the seventh and eighth gate valves 37 and 38 are alternately opened and closed. and thereby the first coating material line 11 is cleaned. whereby clogging of the first coating material line 11 with coating material cured in the line can be prevented.

Cleaning of the inside of the coating material lines 11 to 16 is effected together with color change. Cleaning may be effected every time the coating color is changed. However it is generally preferred that a predetermined condition be determined and cleaning be effected only for the coating material which has satisfied the predetermined condition. That is, it is preferred that the tenth to fifteenth gate valves 40 to 45 be normally kept closed and only when the coating material which has satisfied the predetermined condition is changed, the gate valve corresponding to the coating material be opened to clean the inside of the corresponding coating material line.

The predetermined condition may be determined, for instance, on the basis of the elapsed time or the number of times the coating color is changed. Cleaning of the inside of the coating material lines 11 to 16 may be controlled for each coating material line or may be controlled as a whole.

When the predetermined condition is determined on the basis of the elapsed time and cleaning is to be controlled for each line, cleaning of the coating material line for a certain coating material may be effected together with color change which is effected a predetermined time after change from said certain coating material to another coating material. The predetermined time employed herein may be uniform for all the coating materials (e.g., 10 minutes), or may be set for each coating material since the curing time differs from material to material.

When the predetermined condition is determined on the basis of the elapsed time and cleaning of the coating material line is effected simultaneously for all the coating materials, cleaning may be effected together with color change which is effected a predetermined time after the preceding cleaning.

When the predetermined condition is determined on the basis of the number of times of color change and cleaning is to be controlled for each line, cleaning of the coating material line for a certain coating material may be effected together with color change which is effected after a predetermined number of color changes as numbered from color change from said certain coating material to another coating material. The predetermined number of color changes employed herein may be uniform for all the coating materials, or may be set for each coating material.

When the predetermined condition is determined on the basis of the number of times of color change and cleaning of the coating material line is effected simultaneously for all the coating materials, cleaning may be effected together with color change which is effected after a predetermined number of color changes as numbered from the preceding cleaning Cleaning of the inside of the coating material lines is preferably effected before cleaning of the front end portions of the coating material lines by cleaner ejected from the cleaner line 17 (the cleaner nozzle 17*b*). That is, for example, the inside of the first coating material line 11 is to be cleaned together with a certain color change, the operation of opening the seventh and tenth gate valves 37 and 40 to supply thinner and the operation of opening the eighth and tenth gate valves 38 and 40 to supply pressurized air are alternately repeated, thereby cleaning the inside of the first coating material line 11 first, and then the seventh to ninth gate valves 37 to 39 are opened to clean the front end portion of the first coating material line 11 by cleaner ejected through the cleaner line 17.

In the first embodiment, the coating material passages 11*a* to 16*a* of the first to sixth coating material lines 11 to 16 and the coating material nozzles 11*b* to 16*b* are disposed around the cleaner passage 17*a* of the cleaner line 17 and the cleaner nozzle 17*b* at a predetermined angular intervals and the front end portions of the coating material nozzles 11*b* to 16*b* are cleaned by thinner and pressurized air radially ejected from the coating material line cleaning nozzle openings 52. Accordingly, the front end portions of the coating material nozzles 11*b* to 16*b* are easily cleaned by thinner and pressurized air through a single cleaner line 17. This greatly simplifies the structure of the bell-shaped head 3 as compared with the conventional system where a cleaner line is provided for each coating material line. Further the passage for each color can be smaller in diameter as compared with that of the conventional system where the cleaner line is provided coaxially with each coating material line, whereby the rotary spraygun 1 can be more compact.

Further since the front ends of the coating material nozzles lib to 16b project toward the partition wall 6 beyond the coating material line cleaning nozzle openings 52 and at the same time thinner and pressurized air ejected through the openings 52 are guided near the front ends of the coating material nozzles 11*b* to 16*b* by the guide passage 53, coating material adhering to the front end portions of the coating material nozzles 11*b* to 16*b* can be smoothly and surely removed.

Further since thinner and pressurized air are supplied toward the top of the conical protrusion 55 on the inner surface of the partition wall 6 through the central nozzle opening 54 of the cleaner nozzle 17*b*, the thinner and the pressurized air are effectively led to the inner surface of the partition wall 6 as well as by virtue of the slope of the protrusion 55, whereby the inner surface of the partition wall 6 can be surely cleaned. At the same time, since the central opening 56 extends through the partition wall 6 at the center thereof substantially opposed to the central nozzle opening 54, the thinner and the pressurized air supplied toward the partition wall 6 through the central nozzle opening 54 are ejected to the outer surface of the partition wall 6 through the central opening 56, whereby the outer surface of the partition wall 6 can be effectively cleaned.

Figure 7:
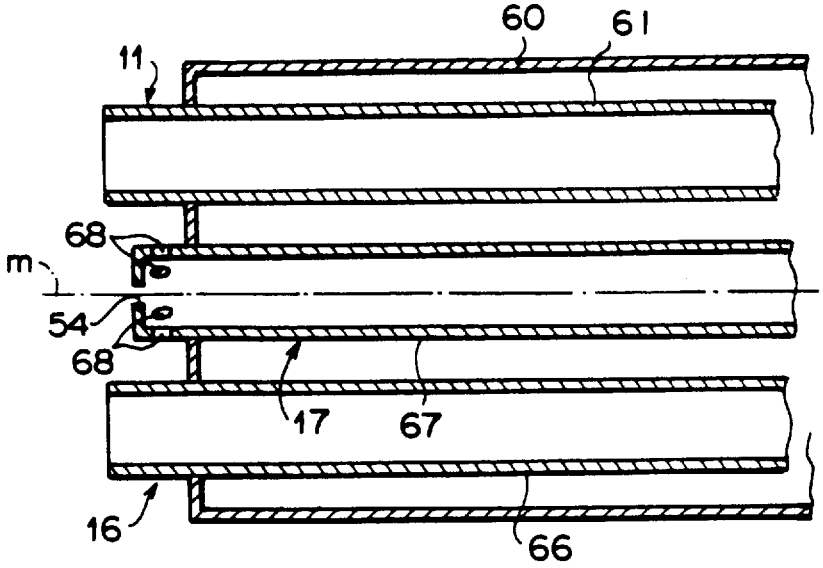
FIG. 7 is a cross-sectional view showing the coating material passage portions and the cleaner passage portion employed in a second embodiment of the present invention.
Figure 8:
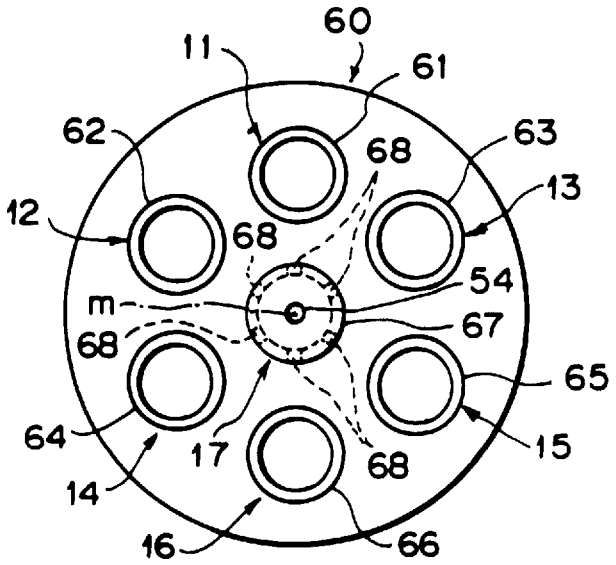
FIG. 8 is a front view showing the coating material passage portions and the cleaner passage portion.

A second embodiment of the present invention will be described with reference to FIGS. 7 and 8, hereinbelow.

The second embodiment mainly differs from the first embodiment in the structure of the coating material passages and the cleaner passage.

That is, in this embodiment, the coating material passages of the coating material lines 11 to 16 are integrally formed with the respective coating material nozzles into coating material passage portions 61 to 66 and the cleaner passage of the cleaner line 17 is integrally formed with the cleaner nozzle into a cleaner passage portion 67. The coating material passage portions 61 to 66 and the cleaner passage portion 67 are housed in a tubular core material 60 having a bottom at its front end. Six coating material line cleaning nozzle openings 68 are formed in the peripheral wall of the front end portion of the cleaner passage portion 67 at intervals of 60° to be respectively opposed to the front end of the coating material passage portions 61 to 66. The other arrangements of the coating material passage portions and the cleaner passage portion are the same as those in the first embodiment, and accordingly the analogous parts are given the same reference numerals and will not be described in detail here.

In this embodiment, since the passage portion and the nozzle are formed integrally with each other for each of the coating material lines and the cleaner line, the number of parts can be reduced and assembly of the rotary spraygun can be facilitated Further since the coating material passage portions 61 to 66 and the cleaner passage portion 67 are easy to replace, whereby service is facilitated. Further unlike the first embodiment, the six coating material line cleaning nozzle openings 68 opposed to the front ends of the coating material passage portions 61 to 66 eliminate the necessity of a guide passage.

The present invention need not be limited to the embodiments described above but may be variously modified. For example, though in each embodiment, six coating material lines 11 to 16 are disposed around the cleaner line 17, the number of the coating material lines may be not larger than 5 or not smaller than 7.

Further though in each embodiment, the central opening 56 is provided in the center of the partition wall 6, such a central opening may be eliminated.

What is claimed is:

1. A multi-color rotary spraygun comprising a bell-shaped head which is supported for rotation on a front end of a casing and the front end portion of which is covered with a partition wall having coating material spraying ports, and a plurality of coating material lines which open into the bell-shaped head at their front ends and are respectively connected to separate coating material sources at their base ends, a coating material supplied to the bell-shaped head from one of the coating material sources through one of the coating material lines being atomized and sprayed on an object through the spraying ports by rotation of the bell-shaped head, wherein the improvement comprises that the front end portion of a cleaner line which is connected to a cleaner source at its base end is disposed in said bell-shaped head and the front end portion of said coating material lines are disposed around the front end portion of the cleaner line; and a coating material line nozzle opening is provided in a peripheral wall of the front end portion of the cleaner line and cleaner supplied from the cleaner source through the cleaner line is ejected radially through the coating material line nozzle opening and cleans the front end portions of the coating material lines.

2. A multi-color rotary spraygun as defined in claim 1 in which the front ends of the coating material lines project toward the partition wall beyond the coating material line nozzle opening.

3. A multi-color rotary spraygun as defined in claim 1 in which a guide passage for leading the cleaner ejected through the coating material line nozzle opening to the front ends of the coating material lines is formed on the outer peripheral surface of the front end portion of the cleaner line.

4. A multi-color rotary spraygun as defined in claim 1 in which the front end portion of the cleaner line extends on the rotational axis of the bell-shaped head and the front end portions of the coating material lines are disposed around the front end portion of the cleaner line at predetermined angular intervals.

5. A multi-color rotary spraygun as defined in claim 1 in which the front end face of each of the coating material lines is tapered so that the distance from the partition wall decreases toward the rotational axis of the bell-shaped head.

6. A multi-color rotary spraygun as defined in claim 1 in which the front end portion of the cleaner line extends on the rotational axis of the bell-shaped head.

7. A multi-color rotary spraygun as defined in claim 6 in which a central nozzle opening is formed in the front end of the cleaner line to supply cleaner toward the partition wall opposed to the front end of the cleaner line.

8. A multi-color rotary spraygun as defined in claim 7 in which a central opening is formed in the central portion of the partition wall to extend through the partition wall at a portion substantially opposed to the central nozzle opening.

9. A multi-color rotary spraygun as defined in claim 7 in which said partition wall is provided with a protrusion which projects toward the central nozzle opening.

10. A multi-color rotary spraygun as defined in claim 9 in which a central opening is formed near the base of the protrusion to extend through the partition wall in the central portion thereof substantially opposed to the central nozzle opening.

11. A multi-color rotary spraygun as defined in claim 1 in which said cleaner line has a cleaner piping portion which leads the cleaner from the cleaner source to the front end portion of the cleaner line and the cleaner piping portion is provided with a cleaner supply gate valve which cuts and supplies the cleaner to the front end portion of the cleaner line.

12. A multi-color rotary spraygun as defined in claim 11 in which the cleaner supply gate valve comprises a cleaner source gate valve which selectively provides and breaks communication between the cleaner source and the cleaner line and a cleaner line gate valve which selectively provides and breaks communication between the cleaner piping portion and the front end portion of the cleaner line.

13. A multi-color rotary spraygun as defined in claim 1 in which each of the coating material lines has a coating material piping portion which leads the coating material from the coating material source to the front end portion of the coating material line and the coating material piping portion is provided with a coating material supply gate valve which cuts and supplies the coating material to the front end portion of the coating material line.

14. A multi-color rotary spraygun as defined in claim 13 in which a cleaner piping for the coating material line is provided between the coating material pipings and the cleaner piping and a cleaner supply gate valve for the coating material piping which selectively cuts and supplies the cleaner to the coating material pipings is provided in the cleaner piping for the coating material line.

15. A multi-color rotary spraygun as defined in claim 1 in which the cleaner line and the coating material lines are disposed in a cylindrical rotary shaft of a motor for rotating the bell-shaped head.

16. A method of cleaning a multi-color rotary spraygun comprising the steps of;

providing a bell-shaped head and a cleaner line and a plurality of coating material lines whose front ends open into the bell-shaped head, the coating material lines being connected respectively to separate coating material sources of different colors and the coating material in one of the coating material sources being selectively supplied to the bell-shaped head, said coating material line including a coating material line nozzle opening provided in a peripheral wall of a front end portion of the cleaner line, supplying a cleaner to said cleaner line: and ejecting the cleaner through said cleaner line and radially outward through the coating material line nozzle to clean the bell-shaped head and the front end portions of the coating material lines which are disposed around the cleaner line when the coating color is changed.

17. A method of cleaning a multi-color rotary spraygun as defined in claim 16 wherein an inside of at least one of the coating material lines is cleaned when the coating color is changed.

18. A method of cleaning a multi-color rotary spraygun as defined in claim 17 in which cleaning of the inside of the coating material line is effected simultaneously for all the coating material lines and is effected together with color change which is effected after a predetermined number of color changes as numbered from the preceding cleaning.

19. A method of cleaning a multi-color rotary spraygun as defined in claim 17 in which cleaning of the coating material line for a certain coating material is effected together with color change which is effected after a predetermined number of color changes as numbered from color change from said certain coating material to another coating material.

20. A method of cleaning a multi-color rotary spraygun as defined in claim 17 in which cleaning of the inside of the coating material line is effected before cleaning of the front end portions of the coating material lines.

21. A method of cleaning a multi-color rotary spraygun as defined in claim 17 in which cleaning of the inside of the coating material line for a certain coating material is effected together with color change which is effected a predetermined time after change from said certain coating material to another coating material.

22. A method of cleaning a multi-color rotary spraygun as defined in claim 17 in which cleaning of the inside of the coating material line is effected simultaneously for all the coating material lines and is effected together with color change which is effected a predetermined time after the preceding cleaning.

23. A multi-color rotary spraygun comprising a bell-shaped head which is supported for rotation on a front end of a casing and the front end portion of which is covered with a partition wall having coating material spraying ports, a singular cleaner line centrally positioned within said bell-shaped head, and a plurality of coating material lines which open into the bell-shaped head at their front ends and are respectively connected to separate coating material sources at their base ends, said coating material lines being circumferentially spaced about a periphery of said cleaner line, wherein a coating material supplied to the bell-shaped head from one of the coating material sources through one of the coating material lines being atomized and sprayed on an object through the spraying ports by rotation of the bell-shaped head;

wherein each of said plurality of coating material lines includes a nozzle opening provided in a peripheral wall of a front end portion of said cleaner line and cleaner supplied from a cleaner source through said cleaner line is ejected radially through the coating material line nozzle openings and cleans the front ends of the coating material lines.

24. A multi-color rotary spraygun as defined in claim 23 in which a coating material line nozzle opening is provided in the front end portion of the cleaner line and cleaner supplied from the cleaner source through the cleaner line is ejected radically through the coating material line nozzle opening and cleans the front end portion of the coating material lines.

25. A multi-color rotary spraygun as defined in claim 24 in which the front ends of the coating material lines project toward the partition wall beyond the coating material line nozzle opening.

* * * * *